US007307367B2

(12) United States Patent
Angerpointner et al.

(10) Patent No.: US 7,307,367 B2
(45) Date of Patent: Dec. 11, 2007

(54) SLIP-RING ELEMENT AND METHOD FOR ITS MANUFACTURE

(75) Inventors: Ludwig Angerpointner, Munich (DE); Klaus Drost, Wolfratshausen (DE)

(73) Assignee: LTN Servotechnik GmbH, Otterfing (DE)

( * ) Notice: Subject to any disclaimer, the term of this patent is extended or adjusted under 35 U.S.C. 154(b) by 73 days.

(21) Appl. No.: 10/856,058

(22) Filed: May 28, 2004

(65) Prior Publication Data

US 2004/0242025 A1 Dec. 2, 2004

(30) Foreign Application Priority Data

May 30, 2003 (DE) ..... 103 24 708

(51) Int. Cl.
*H01R 39/08* (2006.01)

(52) U.S. Cl. ..... 310/232

(58) Field of Classification Search ..... 310/232, 310/233, 128
See application file for complete search history.

(56) References Cited

U.S. PATENT DOCUMENTS 2,551,030 A * 5/1951 Madden ..... 310/232
3,636,394 A * 1/1972 Forste et al. ..... 310/232
4,705,976 A * 11/1987 Cacioppo et al. ..... 310/232
4,871,935 A * 10/1989 Sweet et al. ..... 310/232
4,936,070 A * 6/1990 Michaud ..... 52/40
5,789,832 A * 8/1998 Hwang ..... 310/43
6,398,354 B1 * 6/2002 Lattuca et al. ..... 347/93

FOREIGN PATENT DOCUMENTS

DE 1 926 219 11/1970
EP 0 618 648 10/1994

* cited by examiner

*Primary Examiner*—Dang Le
*Assistant Examiner*—Nguyen Hanh
(74) *Attorney, Agent, or Firm*—Kenyon & Kenyon LLP

(57) ABSTRACT

A method for manufacturing a slip-ring element having contact rings includes the following steps: machining and/or coating lateral sides of the contact rings; mounting the individual contact rings side-by-side, so that they touch each other at the end face; at least partially filling the inner space formed by the side-by-side-mounted contact rings with an adhesive agent, so that the side-by-side-mounted contact rings are cemented to each other after the adhesive agent has hardened; and complete removal of material from the contact rings in the region where they touch at the end face, so that a peripheral, electrically insulating recess is produced along a circumferential line.

15 Claims, 3 Drawing Sheets

SLIP-RING ELEMENT AND METHOD FOR ITS MANUFACTURE

CROSS-REFERENCE TO RELATED APPLICATIONS

The present application claims priority to Application No. 103 24 708.4, filed in the Federal Republic of Germany on May 30, 2003, which is expressly incorporated herein in its entirety by reference thereto.

FIELD OF THE INVENTION

The present invention relates to a method for manufacturing slip-ring elements, and the present invention relates to such a slip-ring element.

BACKGROUND INFORMATION

Slip-ring units are usually made up, inter alia, of two slip-ring elements, namely, a stator and a rotor. The stator may take the form of a slip-ring brush, whereas the rotor may have a series of contact rings. During operation, the slip-ring brush then has sliding contact with the lateral sides or surfaces of the rotating contact rings. Such slip-ring units are used in many technical fields for transmitting electrical signals or electric power from a stationary unit to a rotating electrical unit. To permit the production of slip-ring units having the smallest possible construction space or dimensions, there is a permanent desire for miniaturization of the relevant slip-ring elements.

In German Published Patent Application No. 1 926 219, among other things, a method is described for producing a slip-ring rotor, in which the contact rings are mounted side-by-side and placed in a support form embracing the contact rings. The interior of this stack of contact rings is thereupon filled with a casting or sealing compound. After the casting compound has hardened, this blank is then lathed on the entire lateral side until the individual contact rings are separated from each other.

A similar method is described in European Published Patent Application No. 0 618 648, where a centrifugal process is carried out to better distribute the casting compound. After the casting and hardening processes, the entire lateral side is machined here, as well.

Moreover, methods for manufacturing slip-ring elements are conventional in which contact rings and insulating plastic rings are mounted side-by-side in alternation. When working with a construction of this type, a great number of parting lines are formed which have a negative influence on the precision of the contact-ring pitch. In addition, especially for slip-ring elements having very small dimensions as are increasingly needed, these plastic rings, because they are small, are difficult and troublesome to manipulate, for example, using tweezers.

Thus, conventional methods for producing slip-ring elements have the disadvantage, inter alia, that they are comparatively complicated and time-consuming.

Therefore, it is an aspect of the present invention to provide a method for producing a slip-ring element which may involve a low manufacturing expenditure, and whereby qualitatively high-grade slip-ring elements may be produced.

SUMMARY

The above and other beneficial aspects of the present invention may be achieved by providing a method as described herein and by providing a slip-ring element as described herein.

An example embodiment of the present invention may provide a type of slip-ring element, the construction of which may be inexpensive, and by which the quality, e.g., the service life and/or the reliability, of slip-ring elements may be significantly increased.

Contact rings of a slip-ring element may be already definitively machined and/or coated on their lateral sides before the slip-ring elements are assembled or mounted. After the contact rings have been mounted side-by-side and cemented, and after removal of material from the contact rings in the region where they touch at the end face, the functionally-relevant surfaces on the lateral sides of the contact rings no longer need to be further processed.

In this manner, it is possible to provide the contact rings in the isolated state with a qualitatively high-grade surface for the function of a slip-ring unit. This may be relatively inexpensive and easy to accomplish compared with processes in which these surfaces of the contact rings have to be produced when the slip-ring element is in the assembled state. Thus, the contact rings may be treated or coated in a bulk material, i.e., drum process, while in conventional manufacturing processes, the entire slip-ring element must be treated or coated. If the coating or machining process is faulty, the entire slip-ring element in that case must be regarded as a reject. In contrast, in the method of an example embodiment of the present invention, individual faulty contact rings may be sorted out, so that the damage may be very limited.

In an example embodiment of the present invention, the contact rings are applied on an inner member for the side-by-side mounting.

According to an example embodiment of the present invention, a method for manufacturing a slip-ring element having contact rings includes: at least one of (a) machining and (b) coating lateral sides of the contact rings; mounting individual contact rings side-by-side so that the contact rings touch each other at end faces; at least partially filling an inner space formed by the side-by-side-mounted contact rings with an adhesive agent to cement the side-by-side-mounted contact rings to each other after the adhesive agent has hardened; and completely removing material from the contact rings in a region where the contact rings touch at the end faces to produce a peripheral recess along a circumferential line.

The mounting step may include placing the contact rings onto an inner member of the slip-ring element.

The method may include, prior to the mounting step, contacting cables to the individual contact rings. The cables may be contacted in the contacting step by a welding process.

The lateral sides of the contact rings may be coated in the at least one of the (a) machining and (b) coating step in a bulk-material process.

According to an example embodiment of the present invention, a slip-ring element includes a series of contact rings arranged so that axes of the contact rings each point in a same direction, the contact rings cemented to each other at at least one of (a) inner sides and (b) end faces, a circumferential recess located between the contact rings so that the contact rings have an axial clearance on both sides of the recess.

The slip-ring element may include an inner member that touches the contact rings at the inner side.

The slip-ring element may include an inner member that touches the contact rings at only one segment of the inner side.

The inner member may include a central opening configured to receive an adhesive agent.

The inner member may include a bearing seat configured to mount a bearing.

The inner member may include a shoulder having a stop face for one of the contact rings.

The inner member may include a shoulder having a stop face for the bearing.

According to an example embodiment of the present invention, a slip-ring element includes: a series of contact rings arranged so that axes of the contact rings each point in a same direction, the contact rings cemented to each other at at least one of (a) inner sides and (b) end faces, a circumferential recess located between the contact rings so that the contact rings have an axial clearance on both sides of the recess; and an inner member that touches the contact rings at the inner side, the inner member including a bearing seat configured to mount a bearing.

The inner member may touch the contact rings only at one segment of the inner side.

Further example embodiments of the present invention are described below.

Further details and aspects of the slip-ring element and of the corresponding method are set forth below in the following description of an exemplary embodiment with reference to the appended Figures.

DETAILED DESCRIPTION

Figure 1:
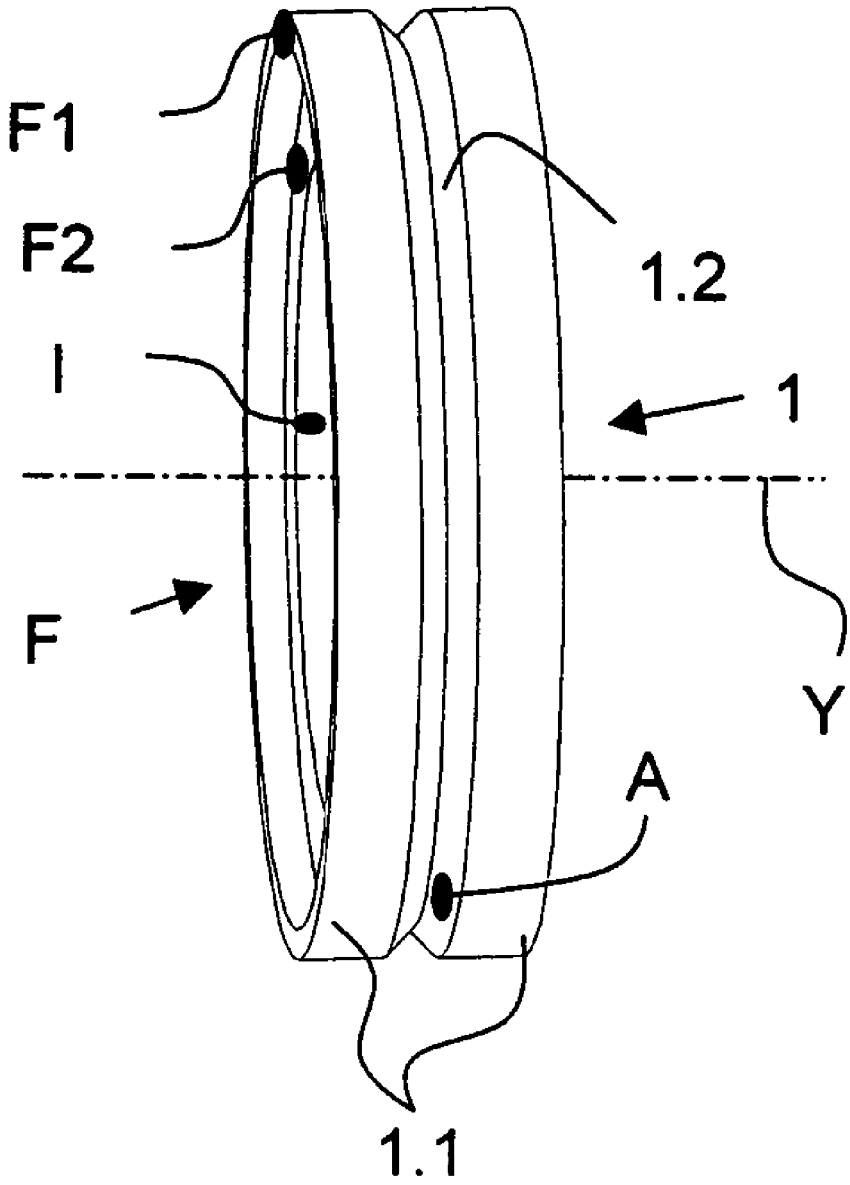
FIG. 1 is a perspective view of a contact ring after first manufacturing step S1.

In a first manufacturing step S1, a contact ring 1 is provided as illustrated in FIG. 1. Contact ring 1 has an axis Y which is orthogonal to an imaginary diameter line of contact ring 1, and about which contact ring 1 rotates during later operation.

Contact ring 1 is produced from a blank made of a copper/zinc/lead alloy, inner side I being bounded by a centrical bore hole through the body of contact ring 1. The surface of inner side I is machined highly accurately in accordance with the demands on a fit. End face F is shaped in graded fashion by a turning process, so that webs 1.1 and end-face partial areas F1 and F2 are formed. Thus, partial area F1 quasi represents the end face of web 1.1, while partial area F2 is the set-back end face of the contact ring. Lateral side A is the curved outer side of contact ring 1. A V-groove 1.2 is introduced into lateral side A by carrying out a diamond-turning process. When machining lateral side A, care may be taken that it exhibit an exceedingly high surface quality, e.g., little roughness.

Contact rings 1 machined in this manner are then coated with an extremely thin gold layer. For this purpose, contact rings 1 are subjected to a highly efficient and inexpensive bulk-material coating process. Therefore, in manufacturing step S1, with comparatively little expenditure in an earlier manufacturing phase, a qualitatively high-grade surface very well suited for the function of a slip-ring unit may be produced on contact ring 1. Later machining of lateral side A, for example, after contact rings 1 have been assembled, may therefore no longer be necessary.

In the example illustrated, contact ring 1 has an outside diameter of only 6.3 mm, while webs 1.1 each have a width in the axial direction of 0.25 mm.

In the next manufacturing step S2, in each case a cable 7 (see FIGS. 2*a*, 2*b*) is electrically contacted to each contact ring 1 at a location on inner side I, thus not on a web 1.1, with the aid of a welding process.

Figure 2B:
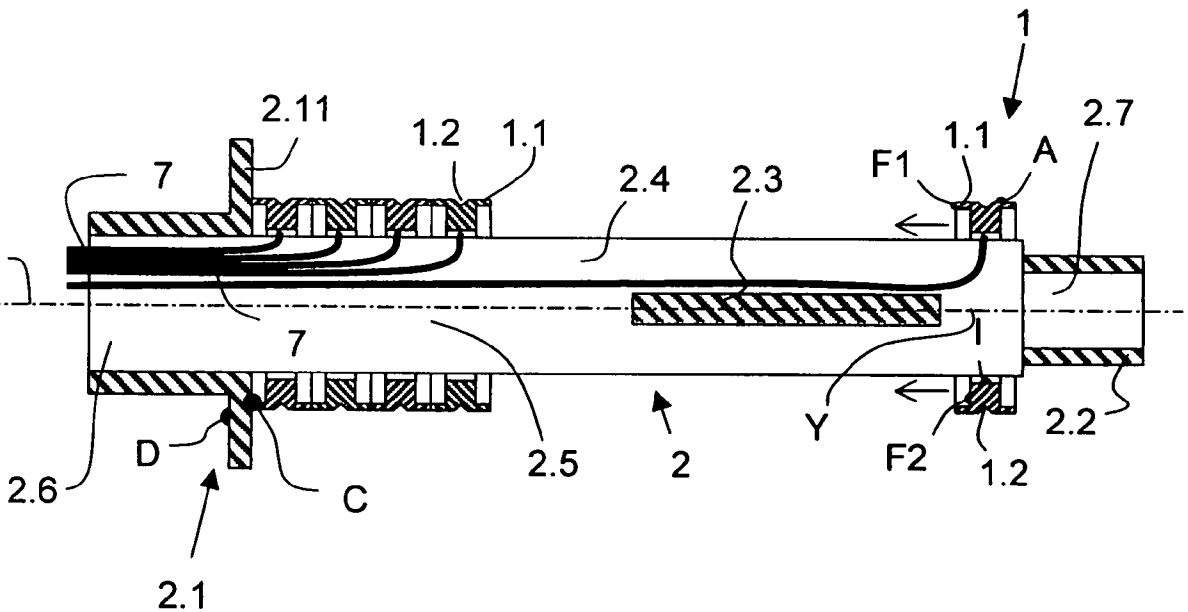
FIG. 2*b* is a longitudinal cross-sectional view through a slip-ring element during manufacturing step S3.
Figure 2A:
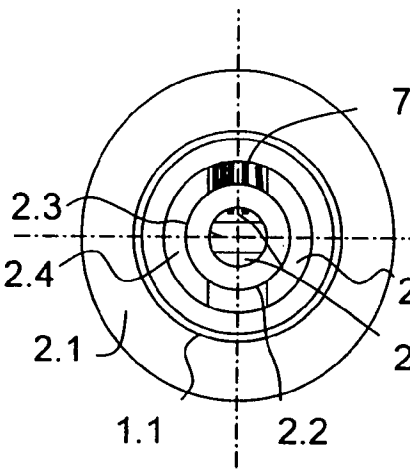
FIG. 2*a* is a side view of a slip-ring element during manufacturing step S3.

Thereupon, in manufacturing step S3, as illustrated in FIGS. 2*a* and 2*b*, contact rings 1 are put or slid unto an inner member 2 of the slip-ring element, inner member 2 being implemented as an injection-molded plastic part. In so doing, contact rings 1 are arranged or aligned so that their axes Y in each case point in the same direction, namely, in the direction of center axis X of the slip-ring element. In the example illustrated, even after assembly, axes Y of contact rings 1 coincide congruently with center axis X of the slip-ring element.

Inner member 2 has, inter alia, two longitudinal ribs 2.4, as well as, on one side, a centrical hollow-cylindrical plug 2.2 having an opening 2.7. Longitudinal ribs 2.4, which extend parallel to center axis X, are joined in a partial region by a crossbar 2.3 for increasing the mechanical rigidity of inner member 2. As illustrated in FIG. 2*a*, in each case longitudinal ribs 2.4 have approximately a cross-section in the form of a circle segment. In the course of assembly, contact rings 1 are slid onto longitudinal ribs 2.4. The outside diameter of the circle segments is dimensioned in accordance with the inside diameter of contact rings 1, so that contact rings 1 may be moved in the radial direction without play along longitudinal ribs 2.4. In this context, contact rings 1 touch inner member 2, i.e., its longitudinal ribs 2.4, only at one segment of their inner side I.

Prior to or while applying contact rings 1 on inner member 2, cables 7 are threaded through a hollow-cylindrical opening 2.6 of inner member 2. In this manufacturing step S3, contact rings 1 are mounted side-by-side such that they touch each other at the end face in the region of webs 1.1, i.e., surfaces F1 of contact rings 1 are pushed together so that they touch. Inner member 2 has a bearing seat 2.1 which includes a shoulder 2.11 having two stop faces C, D. This shoulder 2.11, e.g., stop face C, axially secures contact rings 1, so that when being side-by-side mounted, contact rings 1 only have to be pushed against stop face C of this shoulder 2.11 to achieve a mutual, end-face contact of all contact rings 1. This may facilitate and accelerate the manufacturing process.

Figure 3:
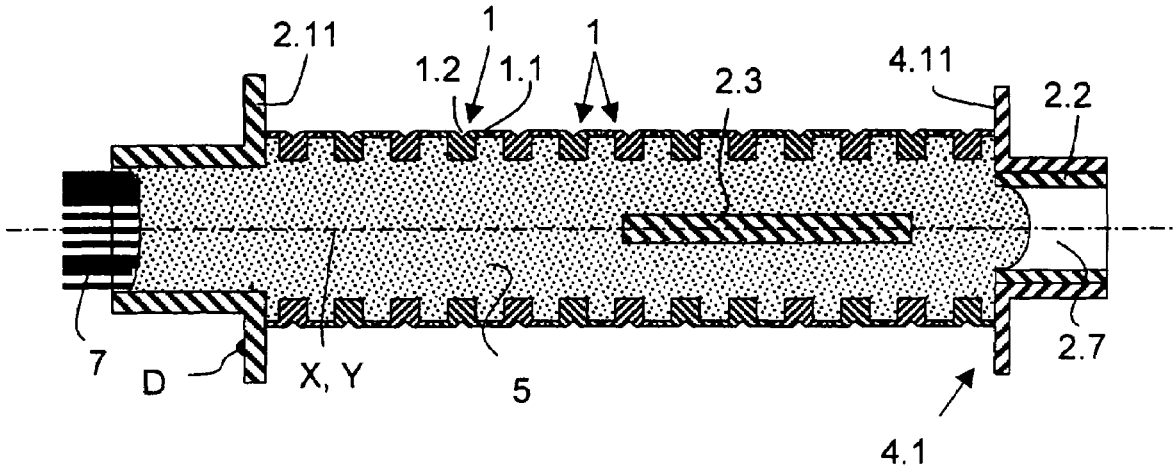
FIG. 3 is shows a longitudinal cross-sectional view through a slip-ring element after manufacturing step S4.

At this point, after all contact rings 1 have been put unto inner member 2 and suitably mounted side-by-side, contact rings 1, i.e., the stack of contact rings 1, surround a hollow inner space. Moreover, this inner space is further axially terminated by slipping onto plug 2.2 a bearing seat 4.1 implemented as a separate plastic part and having a shoulder 4.11 (FIG. 3).

In manufacturing step S4, this inner space is at least partially filled with an adhesive agent 5. For this purpose, adhesive agent 5 is quasi injected through opening 2.7 of plug 2.2 into the inner space. Comparatively viscous adhesive agent 5 flows through opening 2.7 into the inner space and moves there through channels 2.5 to inner sides I and to end-face partial areas F2 of contact rings 1. In so doing, the interspaces located radially within webs 1.1 of contact rings 1 are also at least partially filled with adhesive agent 5. For this manufacturing step S4, the volume of adhesive agent 5 to be introduced is apportioned so that on one hand, the inner space is sufficiently filled with adhesive agent 5, but on the other hand, no adhesive agent 5 may escape at opposite opening 2.6 of the slip-ring element. After the inner space has been filled with adhesive agent 5, it is allowed to harden, so that ultimately side-by-side-mounted contact rings 1 are cemented to each other. In this manner, a slip-ring element is produced which, after manufacturing step S4, may be represented according to FIG. 3.

Adhesive agent 5 should be understood to include materials or casting compounds which have an adhesive property. They may be single-component or multi-component adhesives. Polymers which exhibit the suitable property also fall under the term adhesive agent.

In the next manufacturing step S5, webs 1.1 are completely removed. To that end, the slip-ring element as illustrated in FIG. 3 is clamped in a lathe so that center axis X coincides with the axis of rotation of the lathe. Stop face D of shoulder 2.11 serves the function of a reference surface. Inner member 2, together with contact rings 1 and adhesive agent 5, is pushed onto the clamping device of the lathe up to this shoulder 2.11, i.e., up to stop face D. This stop makes it possible to exactly assign in the lathe, the position of contact rings 1 which mutually contact at the end face in the region of webs 1.1 to be removed. Thus, after the slip-ring element has been clamped in this manner, in the course of machining by turning, a lathe tool which is double the width of webs 1.1 is allowed to recess-turn in the region of webs 1.1. In this manner, the material of contact rings 1 is completely removed by machining in the region of their contact at the end face, so that a peripheral recess 6 is produced along a circumferential line and contact rings 1 are completely separated, i.e., are electrically insulated, from each other. However, lateral sides A that are left, e.g., V-grooves 1.2, of contact rings 1 remain un-machined, and may no longer be needed to be machined later, either.

Figure 4:
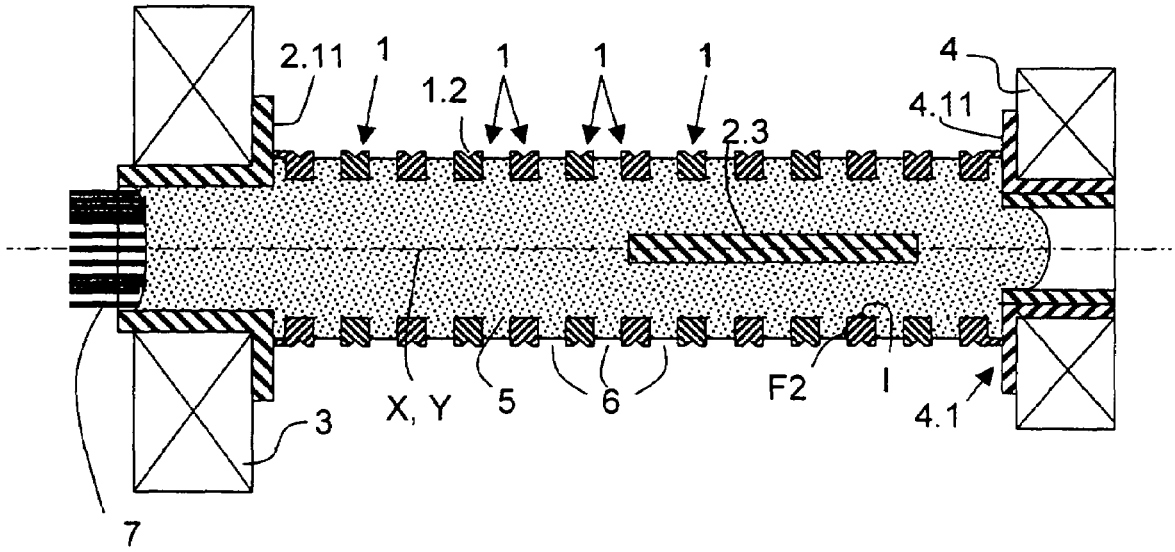
FIG. 4 is a longitudinal cross-sectional through a finished slip-ring element.

After manufacturing step S5, the slip-ring element is removed from the lathe, and bearing 3, e.g., a sealed ball bearing, is slid onto bearing seat 2.1 of inner member 2 up to stop face D of shoulder 2.11. The use of shoulder 2.11 as a stop element may permit a simple and precise assembly. Contact rings 1 are not axially stressed when bearing 3 is slipped on. On the other side of inner member 2, a further bearing 4 is thereupon mounted by sliding it onto bearing seat 4.1 (FIG. 4).

Thus, using the method of an example embodiment of the present invention, a type of slip-ring element may be provided which may be produced inexpensively, accompanied by a small size with excellent quality. This slip-ring element has a series of contact rings 1, the axes Y of which each point in the same direction and coincide congruently with center axis X. Contact rings 1 are cemented to each other at their inner sides I and end faces F2, and have a peripheral recess 6 between contact rings 1 along a circumferential line, so that contact rings 1 have an axial clearance on both sides of recess 6, i.e., in the region of recess 6. Recess 6, i.e., the groove, may thus be so deep in each case that contact rings 1 do not touch each other, that is, have no mutual electrical contact to one another, so that adhesive agent 5 is visible in recesses 6.

As already mentioned, the slip-ring element has an inner member 2 made of plastic. This inner member 2 has a number of design features. First of all, inner member 2 may be implemented so that it touches contact rings 1 at a segment of their inner side I, and therefore a precise radial positioning of contact rings 1 with respect to inner member 2 may be achieved. Longitudinal ribs 2.4, matched with accuracy of fit to the inside diameter of contact rings 1, may be used for centering contact rings 1.

Moreover, hollow-cylindrical plug 2.2 may combine within itself several functions. First of all, inner member 2 may be optimized with respect to the simple and precise introduction of adhesive agent 5 into the inner space formed by side-by-side-mounted contact rings 1. For this purpose, central hollow-cylindrical opening 2.7 is provided, which is similar to a tube connector, and is used as an inlet for an injection device for introducing adhesive agent 5. The adhesive agent is able to spread through opening 2.7 and channel 2.5 provided in inner member 2, radially outwardly to the inner sides of side-by-side-mounted contact rings 1. The outer surface of centrical plug 2.2 also assumes the function of the mounting surface for bearing seat 4.1.

Moreover, inner member 2 has shoulder 2.11 which is designed such that it has both a stop face D for bearing 3, as well as a stop face C for a contact ring 1. Shoulder 2.11 is initially used during assembly as a stop for an outer contact ring 1, thereby permitting a simple and precise assembly. Shoulder 2.11 also represents the stop for bearing 3, so that a simple and accurate manufacturing process may be permitted at this location, as well. Shoulder 2.11 has a third function in the manufacturing process, as well. Namely, it offers a stop face for a gripping tool of the lathe, so that a reference surface is provided for positioning the machining tool relative to the slip-ring element.

The slip-ring element described is used, for example, as a rotor in a slip-ring unit. This rotor then rotates relative to a stator, the brush wires of which glide along V-groove 1.2 of contact rings 1. In this manner, a permanent electrical contact is produced between one brush wire and one contact ring 1, respectively. Because of the excellent surface quality of lateral surface A, e.g., of V-groove 1.2, the slip-ring units having the slip-ring elements or rotors according to an example embodiment of the present invention may have a high quality, which may make itself felt in their reliability and durability. The slip-ring elements of an example embodiment of the present invention may be relatively reasonable to manufacture.

What is claimed is:

1. A slip-ring element, comprising:

an inner member; and a series of contact rings arranged so that axes of the contact rings each point in a same direction, the inner member touching partial surfaces of the contact rings at inner sides of the contact rings, the contact rings cemented to each other at at least one of (a) inner sides and (b) end faces and to the inner member by an adhesive agent at at least one of (a) inner sides and (b) end faces, a circumferential recess located between the contact rings so that the contact rings have an axial clearance on both sides of the recess;

wherein the inner member includes an inlet configured for introduction of the adhesive agent to a longitudinal channel of the inner member that extends radially outwardly to the inner sides of the contact rings, the adhesive agent provided through the opening, to the channel and radially outwardly to the inner sides of the contact rings.

2. The slip-ring element according to claim 1, wherein the inner member touches the contact rings at only one segment of the inner side.

3. The slip-ring element according to claim 1, wherein the inner member includes a central opening configured to receive the adhesive agent.

4. The slip-ring element according to claim 1, wherein the inner member includes a bearing seat configured to mount a bearing.

5. The slip-ring element according to claim 4, wherein the inner member includes a shoulder having a stop face for the bearing.

6. The slip-ring element according to claim 1, wherein the inner member includes a shoulder having a stop face for one of the contact rings.

7. The slip-ring element according to claim 1, wherein the adhesive agent fills the channel.

8. The slip-ring element according to claim 1, wherein the inner member touches the same partial surface of each contact ring.

9. A slip-ring element, comprising:

a series of contact rings arranged so that axes of the contact rings each point in a same direction, the contact rings cemented to each other by an adhesive agent at at least one of (a) inner sides and (b) end faces, a circumferential recess located between the contact rings so that the contact rings have an axial clearance on both sides of the recess; and an inner member that touches partial surfaces of the contact rings at the inner side, the contact rings cemented to the inner member by the adhesive agent, the inner member including a bearing seat configured to mount a bearing;

wherein the inner member includes an inlet configured for introduction of the adhesive agent to a longitudinal channel of the inner member that extends radially outwardly to the inner sides of the contact rings, the adhesive agent provided through the opening, to the channel and radially outwardly to the inner sides of the contact rings.

10. The slip-ring element according to claim 9, wherein the inner member touches the contact rings only at one segment of the inner side.

11. The slip-ring element according to claim 9, wherein the adhesive agent fills the channel.

12. The slip-ring element according to claim 9, wherein the inner member touches the same partial surface of each contact ring.

13. A slip-ring element, comprising:

an inner member including an inlet and a channel extending longitudinally from the inlet and radially outwardly to an outer periphery of the inner member;

a series of contact rings arranged on the outer periphery of the inner member, axes of the contact rings each pointing in a same direction, the inner member touching partial surfaces of the contact rings at inner sides of the contact rings, a circumferential recess located between the contact rings so that the contact rings have an axial clearance on both sides of the recess; and an adhesive agent provided in the inlet and filling the channel, the contact rings cemented to each other at at least one of (a) inner sides and (b) end faces and to the inner member by the adhesive agent at at least one of (a) inner sides and (b) end faces.

14. The slip-ring element according to claim 13, wherein the inner member touches the same partial surface of each contact ring.

15. The slip-ring element according to claim 13, wherein the inner member includes a bearing seat configured to mount a bearing.

* * * * *